United States Patent [19]

Pringle

[11] Patent Number: 4,977,957

[45] Date of Patent: Dec. 18, 1990

[54] SUBSURFACE WELL SAFETY VALVE WITH LIGHT WEIGHT COMPONENTS

[75] Inventor: Ronald E. Pringle, Houston, Tex.

[73] Assignee: Camco International Inc., Houston, Tex.

[21] Appl. No.: 415,677

[22] Filed: Oct. 2, 1989

[51] Int. Cl.[5] ..... E21B 34/10

[52] U.S. Cl. ..... 166/321; 166/323; 166/332; 251/368

[58] Field of Search ..... 166/316, 319, 321, 322, 166/332, 323; 251/368, 62

[56] References Cited

U.S. PATENT DOCUMENTS

| | | | |
|---|---|---|---|
| 2,591,174 | 4/1952 | Martin | 251/368 |
| 3,035,642 | 5/1962 | Page | 166/321 |
| 3,095,900 | 7/1963 | Newhall | 251/368 X |
| 4,161,219 | 7/1979 | Pringle | 166/324 |
| 4,254,832 | 3/1981 | Patton et al. | 166/332 |
| 4,716,968 | 1/1988 | Pringle | 166/319 |

FOREIGN PATENT DOCUMENTS

| | | | |
|---|---|---|---|
| 2412768 | 8/1979 | France | 251/343 |
| 2096279 | 10/1982 | United Kingdom | 251/368 |

*Primary Examiner*—Hoang C. Dang

*Attorney, Agent, or Firm*—Fulbright & Jaworski

[57] ABSTRACT

A subsurface well safety valve having a housing with a valve seat positioned in the housing and a valve closure member movable between open and closed positions. A flow tube is telescopically movable in the housing for controlling the movement of the valve closure member, a biasing member in the housing acts on the flow tube moving the valve to a closed position, and a hydraulic piston and cylinder assembly actuates the flow tube. The flow tube and/or the valve closure member are made of a light weight material, and allow the use of smaller and less expensive springs. The low weight flow tube reduces the required output of the biasing member and/or allows the valve to be set deeper.

12 Claims, 2 Drawing Sheets

Fig. 2
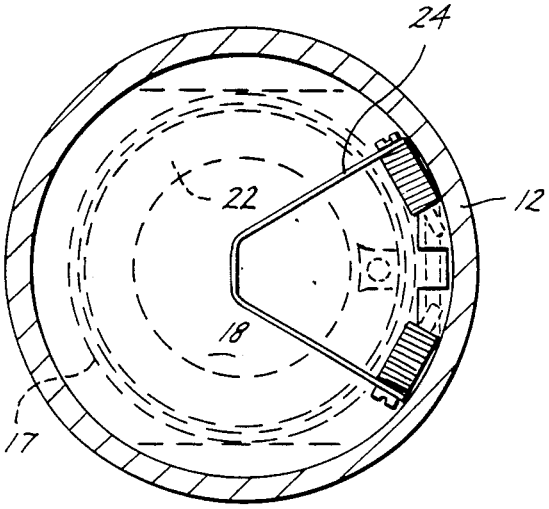
Fig. 3
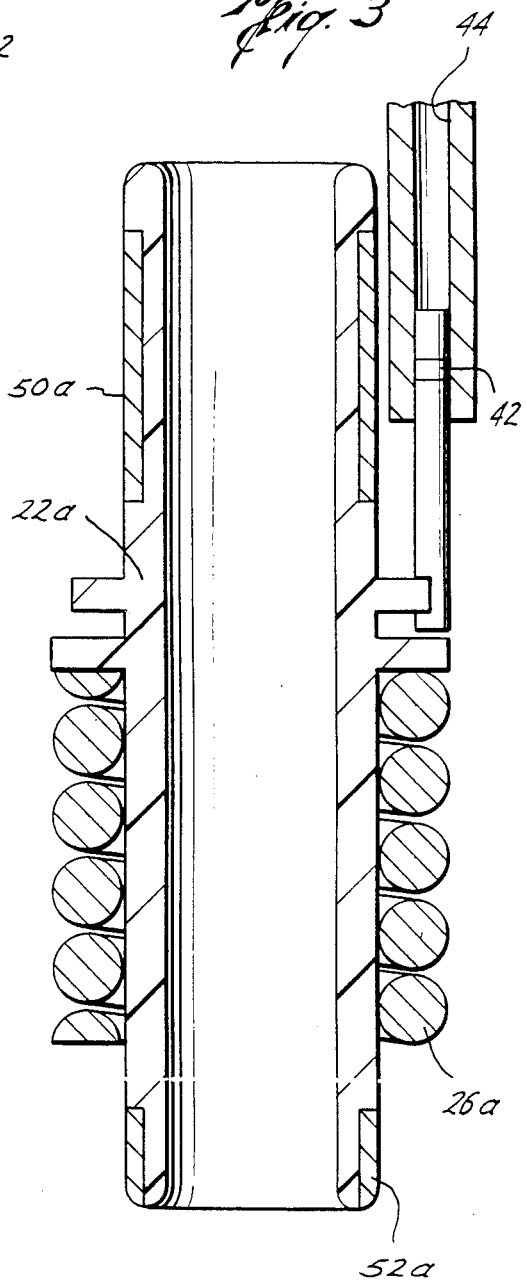
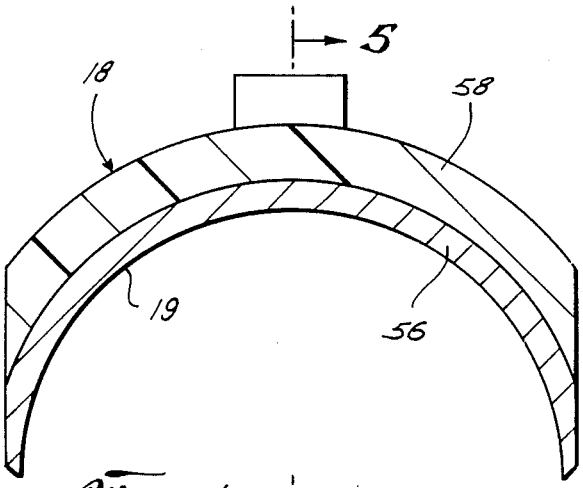
Fig. 4
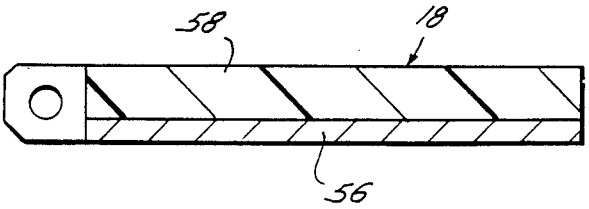
Fig. 5

SUBSURFACE WELL SAFETY VALVE WITH LIGHT WEIGHT COMPONENTS

BACKGROUND OF THE INVENTION

It is known, as disclosed in U.S. Pat. No. 4,161,219 that the effects of hydrostatic forces in the hydraulic control line acting on a subsurface well safety valve can be reduced by using a small area, rod type piston and cylinder assembly. This allows the safety valve to be set at greater depths and/or reduce the required biasing force. Presently conventional rod piston and cylinder assemblies use a quarter inch diameter rod which provides a hydraulic working area of 0.049 square inches. It does not appear to be feasible to provide much smaller areas. Therefore further reducing the hydraulic area in order to overcome hydrostatic forces appears to be limited. However, the biasing means, generally a power spring in the subsurface well safety valve, is used to move the valve to a closed position. The biasing spring must not only overcome the hydrostatic force acting upon the piston and cylinder assembly, but must move the flow tube to the closed position. Therefore, the biasing power spring must be sized and uses a large percentage of its power output, particularly when using small area hydraulic area piston and cylinder assemblies, to overcome the weight of the flow tube.

One feature of the present invention is the provision of providing a light weight, non-ferrous flow tube which reduces the biasing force required out of the spring and/or allows the valve to be set at greater depths.

Another problem in safety valves is that the spring which moves the flapper to the closed position require restricted design parameters. Another feature is the provision of a lightweight, non-ferrous flapper which again allows for the use of a smaller, weaker and less expensive spring.

SUMMARY

The present invention is directed to a subsurface well safety valve for controlling the fluid flow through a well conduit and includes a housing having an axial bore therethrough, a valve seat positioned in the housing, and a valve closure member movable between open and closed positions relative to the valve seat. A flow tube is telescopically movable in the housing for controlling the movement of the valve closure member and biasing means are provided in the housing acting on the flow tube for moving the valve to a closed position. A hydraulic piston and cylinder means is provided in the housing actuating the flow tube. The flow tube and/or the valve closure member are of a material having a density of substantially less than 0.3 pounds per cubic inches. The light weight flow tube allows the use of a less powerful and/or less expensive spring and/or allows the safety valve to be set at a greater depth for overcoming hydrostatic forces. The use of a light weight valve closure member allows for a simpler, cheaper, and smaller closing spring for the flapper valve closure member.

Still a further object of the present invention is wherein the flow tube and/or the valve closure member includes a plastic material.

Yet a still further object of the present invention is wherein the flow tube and/or the valve closure member includes metal and plastic.

Still a further object of the present invention is wherein the flow tube includes plastic and includes a metal support ring at the bottom for supporting the plastic as it contacts the valve closure member. Preferably, the metal support ring includes a plastic ring around the outside of the metal support ring for protecting the valve closure member from the metal.

Still a further object of the present invention is wherein the flow tube includes a metal lockout sleeve, if desired.

Yet a still further object of the present invention is wherein the flapper valve closure member includes a metal sealing surface and a plastic body.

A further object of the present invention is wherein the valve closure member is a flapper valve of a material comprising a light weight, non-ferrous material having a density substantially less than 0.3 pounds per cubic inch.

Yet a still further object of the present invention is wherein the weight of the flow tube in pounds does not exceed the hydraulic area of the rod piston and cylinder assembly in square inches by a factor of more than 400.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIG. 2 is a cross-sectional view taken along the line 2—2 of FIG. 1, FIG. 3 is a schematic, elevational view, in cross section, of another embodiment of the flow tube of the present invention, FIG. 4 is an enlarged elevational view, of the flapper valve member of the present invention, FIG. 5 is a cross-sectional view taken along the line 5—5 of FIG. 4.

DESCRIPTION OF THE PREFERRED EMBODIMENT

While the present invention will be described as used in a tubing retrievable subsurface well safety valve having a curved flapper valve, for purposes of illustration only, the present invention may be used in other types of well subsurface safety valves, such as retrievable valves, and those having flat flapper type closure members and ball type closure type members.

Figure 1A:
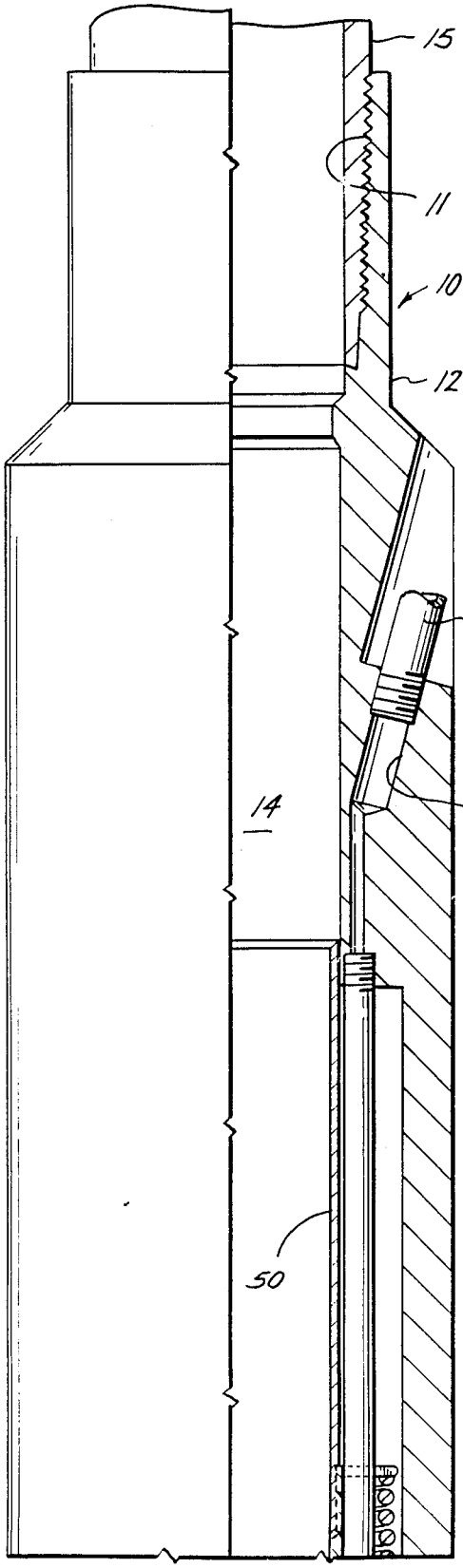
FIGS. 1A and 1B are continuations each other and are in elevational view, partly in cross section, illustrating a subsurface well safety valve of the present invention shown in the open position.
Figure 1B:
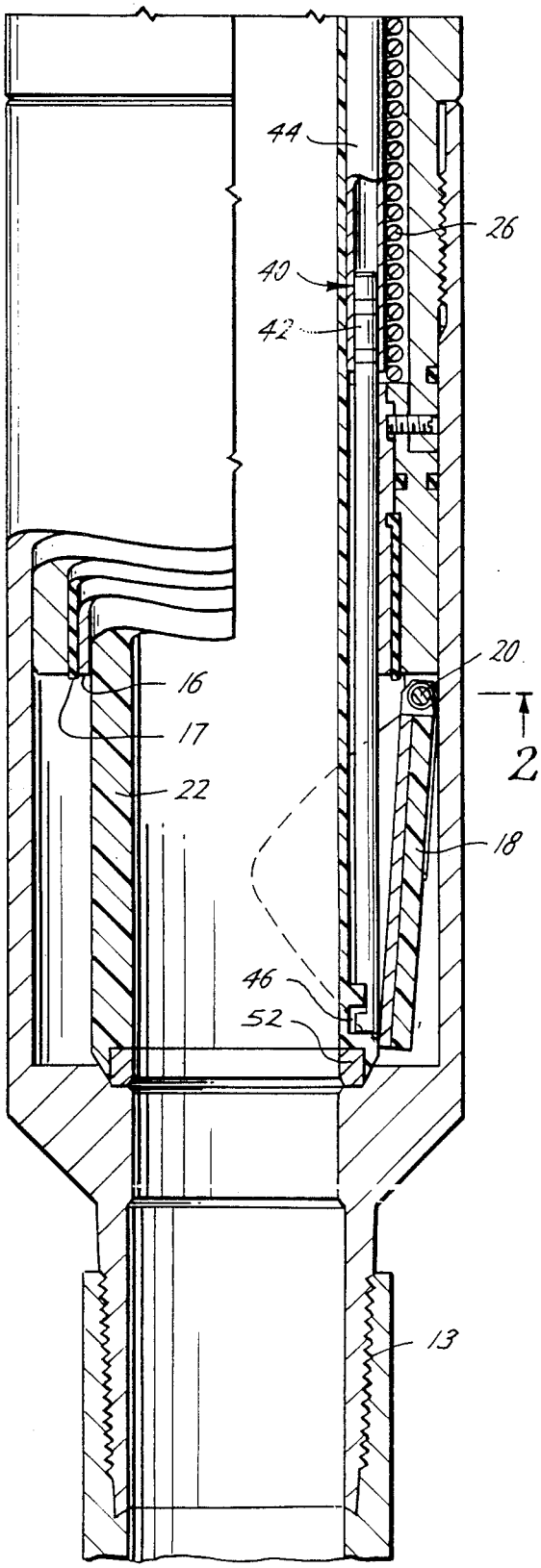

Referring now to the drawings, and particularly to FIGS. 1A and 1B, the reference numeral 10 generally indicates a tubing retrievable subsurface safety valve. The valve includes a housing 12 which is threaded at each end 11 and 13 for connection in a well tubing 15. The valve 10 permits well production therethrough under normal operating conditions, but the valve 10 may be closed in response to abnormal conditions.

The valve 10 includes an axial bore 14, a curved valve seat 16 positioned about the bore 14 in the housing 12, and a valve closure member, such as curved flapper 18 which is connected to the body by a pivot pin 20. When the flapper 18 is in the upper position and seated on the valve seat 16, the safety valve 10 is closed, blocking flow upwardly through the bore 14 and well tubing. A flow tube or longitudinal tubular member 22 is telescopically movable in the body 12 and through the valve seat 16. As best seen in FIG. 1B, when the flow tube 22 is moved in a downward position, the tube 22 pushes the flapper 18 away from the valve seat 16. Thus, the valve 10 is held in the open position so long as the tube 22 is in the downward position. When the tube 22 is moved upwardly, the flapper 18 is allowed to move upwardly on to the seat 16 by the action of a spring 24 (FIG. 2) and also by the action of fluid flow moving upwardly through the bore 14.

The flow tube 22 is biased in an upward direction by suitable biasing means which may include a power spring 26 for yieldably urging the flow tube 22 in an upward direction to release the flapper 18 for closing the valve 10. The safety valve 10 is operated by the application or removal of a pressurized fluid, such as hydraulic fluid, through a control port 38 in the housing 12 from a control line 39 extending to the well surface for supplying pressurized fluid to the top of a rod piston and cylinder means or assembly, generally indicated by the reference numeral 40. The assembly 40 includes a piston 42 movable in a cylinder 44, one of which, here shown as the piston 42, may be connected to the flow tube 22 by a tongue and groove connection 46.

Preferably, the flapper 18 is a sector of a cylinder and includes an internal diameter or concave surface 19 (FIG. 4) which forms a sealing surface. The valve seat 16 includes a coacting seating surface contoured to coact with the sealing surface 19. Preferably, the valve seat 16 is metal and, if desired, may include a soft seat insert 17 positioned around its outer periphery of the hard seat 16 and which is also contoured to coact with the sealing surface 19. The soft seat 17 may be of any suitable material, such as an elastomer.

The use of a rod piston and cylinder assembly in a well safety valve for reducing the hydrostatic force of the fluid acting on the piston and cylinder assembly 40 is disclosed in U.S. Pat. No. 4,161,219. While the use of a small hydraulic area piston and cylinder assembly 40 reduces the hydrostatic head, the biasing means, such as the power spring 26, must not only overcome the hydrostatic head in line 39 acting on the cylinder and piston assembly 40, but must raise the flow tube 22 in order to close the safety valve 10. The flow tube 22 in the prior art is normally steel, and for a typical 5½ inch safety valve, the flow tube would weigh 100 pounds. This 100 pound weight as compared to the hydrostatic head operating on a small hydraulic area piston and cylinder assembly 40 requires a large portion of the output from the power spring 26. Similarly, in the prior art patents, the flapper valve 18, whether curved or flat, is normally steel and for a 5½ inch safety valve would weigh approximately 10 pounds. Because of the tight design parameters required in the space available, the spring 24 required rigid design characteristics. Both the spring 26 and the spring 24, and particularly the spring 26, can be quite expensive. Another frequent problem in subsurface well safety valves is that the lower end of the flow tube 22 pushes across the seat line of sealing surface area 19 of the flapper 18 that coacts with the valve seat 16. This has a tendency of reducing the sealing ability of the valve.

The present invention is directed to providing a light weight flow tube 22 and a light weight flapper 18 to reduce the design requirements, power output and expensiveness of the springs 26 and 24, respectively. The present invention provides a flow tube 22 and/or flapper 18 which is comprised of a low weight material. The flow tube 22 and flapper 18 may be made entirely of a low weight material, such as a plastic, for example, carbon-carbon. Of course, any suitable material having a density substantially less than the density of steel, that is, less than 0.3 pounds per cubic inch, may be used, which would include any suitable light density non-ferrous material. Preferably, however, the flow tube 22 may include a metal sleeve 50, for the purpose of dimpling it in accordance with the teachings of U.S. Pat. No. 4,574,889 for providing a sleeve lockout. Of course, other and various types of lockouts may be used or entirely omitted if desired. Also, referring to FIG. 1B, preferably, the lower end of the flow tube 22 includes a steel support ring 52. That is, in some cases, the plastic material of flow tube 22 as it engages the interior surface 19 of the flapper valve 18 may be deformed. Therefore, the ring 52 will provide desirable support to the lower end of the flow tube 22. However, it is preferable that the steel support ring 22 be on the inside circumference of the flow tube 22 leaving a plastic ring around the outside of the metal support ring 52. This insures that the plastic portion of the lower end of the flow tube 22 contacts the sealing line or sealing surface of the interior 19 of the flapper valve 18 upon opening and closing the flapper 18 for protecting the sealing surface.

It is to be noted that plastic material is suitable for the flow tube 22 as it is not a pressure component in the safety valve 10. That is, the flow tube 22 telescopes in the housing 12 without sealing in the housing 12 and thus is subjected to the same pressure environment at all times. The flow tube 22 need only be structurally strong enough to open the flapper valve 18. Furthermore, the use of a plastic flow tube 22 may provide added components in the safety valve 10 which are less subjected to the corrosive environment of oil and gas wells.

Referring now to FIG. 3, another embodiment of the flow tube is shown, in which flow tube **22*a* again is preferably is plastic but includes a metal lockout sleeve 50*a* which is molded into the outside of the top of the flow tube 22. In addition, the steel support ring 52*a* is shown as being on the outer circumference of the flow tube 22*a*** although the embodiment shown in FIG. 1B is preferred.

The advantages of the present low weight flow tube 22 may best be understood by considering a numerical example. Assuming that the piston and cylinder assembly 40 is a conventional quarter-inch rod piston, the hydraulic area of the assembly is 0.049 square inches. Again, assuming that there is a hydrostatic head being applied downwardly on top of the piston and cylinder assembly 40, of 2000 psi, the hydrostatic force in line 39 would be 98 pounds. This is one force which the biasing power spring 26 must overcome in order to close the safety valve, without a safety factor. The other factor which the power spring 26 must overcome is the weight of the flow tube 22, which for example in a 5½ value having a steel flow tube 22 may be 100 pounds. Therefore the spring must overcome a total force of 198 pounds. Using a safety factor, the spring force required out of the spring 26 would be about 225 pounds. However, using a plastic flow tube 22 of the present invention having a total weight of ten pounds, the required spring force out of the biasing spring 26 is reduced by 90 pounds to 135 pounds which amounts to a 40% reduction in spring requirements. Therefore, by the use of the light weight flow tube, the spring 26 can be considerably reduced in size and expense. Or in the alternative, with the same biasing power spring 26 and using the ten pound flow tube 22, the safety valve 10 of the present invention can be set 3,672 feet deeper than the conventional safety valve using a 100 pound flow tube 22.

Referring now to FIGS. 4 and 5, the flapper 18 may be, if desired, made entirely of a suitable plastic, for example, carbon-carbon, or if desired, may be made of a composite plastic and metal as shown. In FIGS. 4 and 5, the flapper 18 includes a metal sealing surface 56 made out of any suitable metal, such as a high strength metal steel, for example, MP-35N, C-276 attached to a plastic molded body 58. A normal 5½ inch curved flapper for a pounds. The preferred embodiment shown in FIGS. 4 and 5 would weigh approximately 1.5 pounds. As previously indicated, this allows the spring 24 which moves the flapper 18 to the closed position to be a weaker, smaller wire diameter which is more easily designed and placed in the inside of the safety valve housing 12.

The coaction of a light weight flow tube 22 is particularly advantageous when it is used in conjunction with a hydraulic piston and cylinder assembly 40 having a small hydraulic area. That is, in the example given, if the hydraulic area of the piston and cylinder assembly were 0.5 square inches, the hydrostatic head force would be 1,000 pounds and therefore the 100 pound steel flow tube would not be as significant. However, in using a hydraulic area of 0.049 square inches, the weight of a 100 pound steel flow tube exceeds the hydrostatic head and therefore doubles the power requirements of the spring 26. Therefore, it is preferred that the weight of the flow tube in pounds does not exceed the hydraulic area of the rod piston and cylinder assembly in square inches by a factor of more than 400.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, will be readily apparent to those skilled in the art and which are encompassed within the spirit of the invention and the scope of the appended claims.

What is claimed is:

1. A subsurface well safety valve for controlling the fluid flow through a well conduit comprising, a housing having an axial bore therethrough, valve seat positioned in the housing, a valve closure member movable between open and closed positions relative to the valve seat, a flow tube telescopically movable in the housing for controlling the movement of the valve closure member, said flow tube being made of a material having a density lesser than that of the housing, biasing means in the housing acting on the flow tube for moving the valve to a closed position, hydraulic piston and cylinder means in the housing actuating the flow tube, and said flow tube being of a material having a density of substantially less than 0.3 pounds/cubic inch for requiring less force from the biasing means to close said valve.

2. The apparatus of claim 1 wherein the valve closure member is of a material having a density of substantially less than 0.3 pounds/cubic inch.

3. The apparatus of claim 1 wherein the flow tube includes a plastic.

4. The apparatus of claim 3 wherein the valve closure member includes a plastic.

5. The apparatus of claim 1 wherein the flow tube includes metal and plastic.

6. The apparatus of claim 2 wherein the valve closure member includes metal and plastic.

7. The apparatus of claim 1 wherein the flow tube includes plastic and includes a metal support ring at the bottom for supporting the plastic.

8. The apparatus of claim 7 wherein the metal support ring includes a plastic ring around the outside of the metal support ring.

9. The apparatus of claim 3 wherein the flow tube includes a metal lockout sleeve.

10. The apparatus of claim 4 wherein the valve closure member includes a metal sealing surface and a plastic body.

11. A subsurface well safety valve for controlling the fluid flow through a well conduit comprising, a housing having an axial bore therethrough, a valve seat positioned in the housing, a valve closure member movable between open and closed positions relative to the valve seat, a flow tube telescopically and non-sealingly movable in the housing for controlling the movement of the valve closure member, said flow tube being made of a material having a density lesser than that of the housing, spring biasing means in the housing acting on the flow tube in a direction for moving the valve to a closed position, a rod piston and cylinder assembly in the housing connected to and actuating the flow tube, and said flow tube and said valve closure member including a light density, non-ferrous material for requiring less force from the biasing spring thereby allowing the valve to overcome greater hydrostatic forces and thus be set at greater depths.

12. A subsurface well safety valve for controlling the fluid flow through a well conduit comprising, a housing having an axial bore therethrough, a valve seat Positioned in the housing, a valve closure member movable between open and closed positions relative to the valve seat, a flow tube telescopically and non-sealingly movable in the housing for controlling the movement of the valve closure member, said flow tube being made of a material having a density lesser than that of the housing, spring biasing means in the housing acting on the flow tube in a direction for moving the valve to a closed position, a rod piston and cylinder assembly in the housing connected to and actuating the flow tube, and the weight of the flow tube in pounds does not exceed the hydraulic area of the rod piston and cylinder assembly in square inches by a factor of more than 400.

* * * * *

UNITED STATES PATENT OFFICE

CERTIFICATE OF CORRECTION

Patent No. 4,977,957 Dated December 18, 1990

Inventor(s) Ronald E. Pringle

It is certified that error appears in the above-identified patent and that said Letters Patent is hereby corrected as shown below:

Column 2, line 40, after "valve" insert -- closure --

Column 4, line 56, delete "value" and insert -- valve --

Column 5, line 12, in front of "pounds" insert -- safety valve would normally weight approximately 10 --

Column 6, line 47, delete "Positioned" and insert -- positioned --

Signed and Sealed this

Fifteenth Day of September, 1992

*Attest:*

DOUGLAS B. COMER

*Attesting Officer*

*Acting Commissioner of Patents and Trademarks*